US010893699B2

(12) United States Patent
Lee

(10) Patent No.: US 10,893,699 B2
(45) **Date of Patent: *Jan. 19, 2021**

(54) LOW IGNITION PROPENSITY CIGARETTE PAPER AND MANUFACTURE THEREOF

(71) Applicant: Altria Client Services LLC, Richmond, VA (US)

(72) Inventor: Michael H Lee, Rogersville, TN (US)

(73) Assignee: Altria Client Services LLC, Richmond, VA (US)

( * ) Notice: Subject to any disclaimer, the term of this patent is extended or adjusted under 35 U.S.C. 154(b) by 11 days.

This patent is subject to a terminal disclaimer.

(21) Appl. No.: 16/284,219

(22) Filed: Feb. 25, 2019

(65) Prior Publication Data

US 2019/0183166 A1 Jun. 20, 2019

Related U.S. Application Data

(63) Continuation of application No. 14/982,167, filed on Dec. 29, 2015, now Pat. No. 10,212,967.

(60) Provisional application No. 62/097,300, filed on Dec. 29, 2014.

(51) Int. Cl.
*A24D 1/02* (2006.01)
*A24C 5/00* (2020.01)

(52) U.S. Cl.
CPC ..... *A24D 1/025* (2013.01); *A24C 5/005* (2013.01)

(58) Field of Classification Search
CPC ..... A24D 1/025
See application file for complete search history.

(56) References Cited

U.S. PATENT DOCUMENTS

| | | | |
|---|---|---|---|
| 4,236,532 | A | 12/1980 | Schweizer et al. |
| 4,889,145 | A | 12/1989 | Adams et al. |
| 2004/0134631 | A1 | 7/2004 | Crooks et al. |
| 2008/0295854 | A1 | 12/2008 | Li et al. |
| 2012/0227754 | A1 | 9/2012 | Norman et al. |
| 2012/0285477 | A1 | 11/2012 | Sherwood et al. |
| 2012/0305013 | A1 | 12/2012 | Brown et al. |

(Continued)

FOREIGN PATENT DOCUMENTS

| | | | |
|---|---|---|---|
| EP | 0864259 | A2 | 9/1998 |
| WO | 2007020532 | A1 | 2/2007 |
| WO | 2008146159 | A2 | 12/2008 |

OTHER PUBLICATIONS

International Search Report and Written Opinion of the International Searching Authority (Forms PCT/ISA/237, PCT/ISA/210 and PCT/ISA/220) dated Apr. 19, 2016, by the International Bureau of European Patent Office in corresponding International Application No. PCT/US2015/067842. (14 pages).

*Primary Examiner* — Eric Yaary
(74) *Attorney, Agent, or Firm* — Buchanan Ingersoll & Rooney PC

(57) ABSTRACT

A wrapper of a smoking article includes a base web and at least one transverse banded region. The banded region includes a first zone, a second zone and a third zone of add-on material. The second zone has about 25% to about 75% less add-on material than the first zone and the third zone. The banded region is about 5 mm to about 9 mm wide and the second zone is centrally located between the first zone and the third zone. The second zone includes a plurality of dots of the add-on material spaced from adjacent dots in the second zone by a distance greater than a distance between adjacent dots in the first zone and the third zone.

8 Claims, 7 Drawing Sheets

(56) References Cited

U.S. PATENT DOCUMENTS

| | | | |
|---|---|---|---|
| 2013/0306088 | A1 | 11/2013 | Rose et al. |
| 2014/0103099 | A1 | 4/2014 | Snow et al. |

FIG. 1
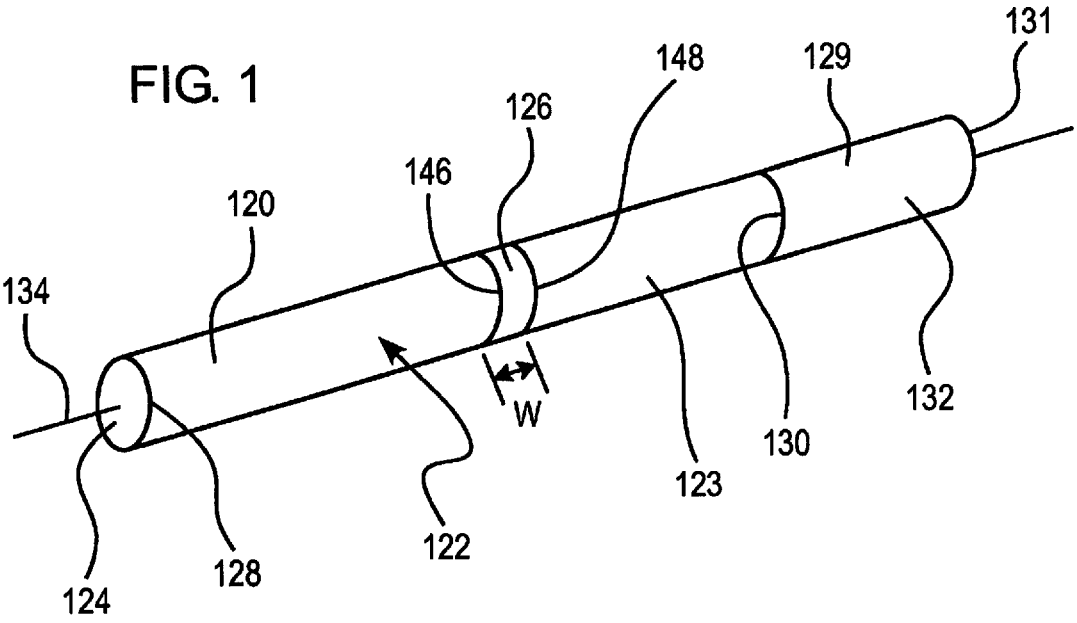
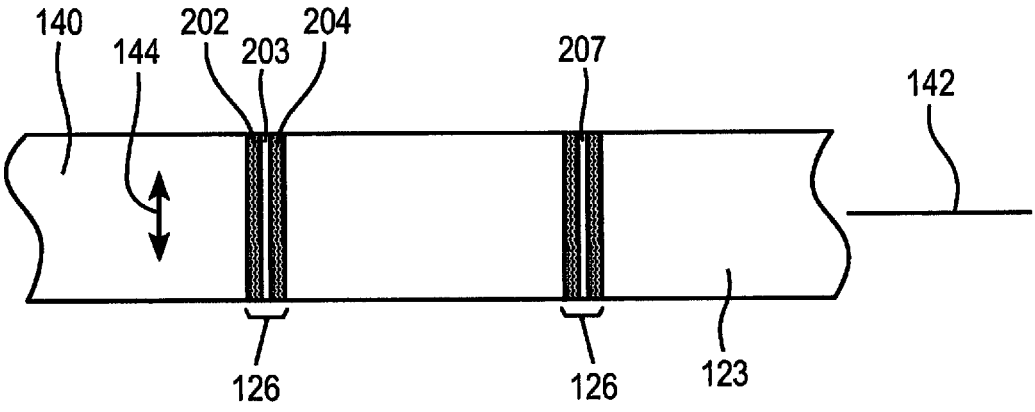
FIG. 2

FIG. 6
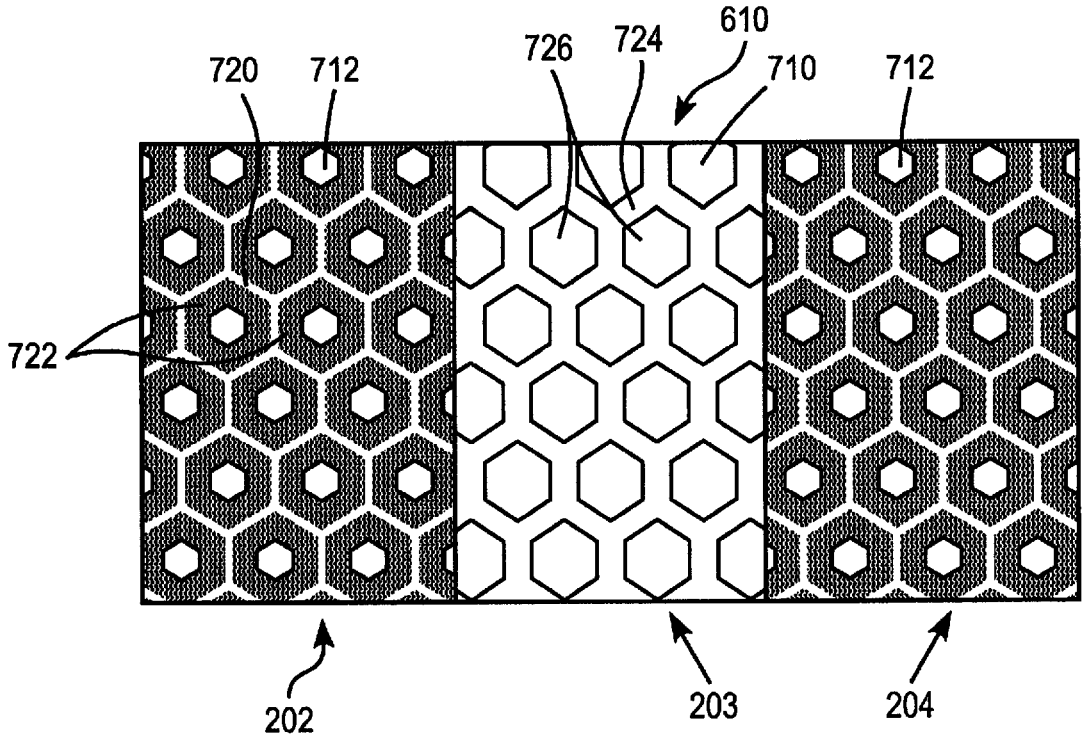
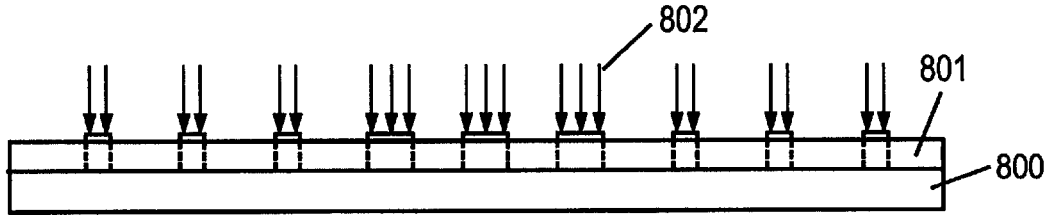
FIG. 7A
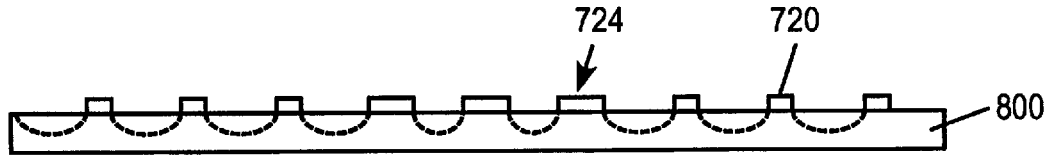
FIG. 7B
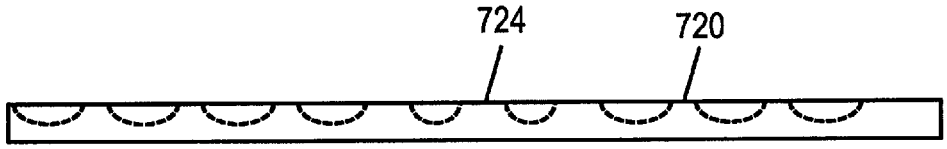
FIG. 7C

LOW IGNITION PROPENSITY CIGARETTE PAPER AND MANUFACTURE THEREOF

This Application is a continuation patent application of U.S. patent application Ser. No. 14/982,167, filed Dec. 29, 2015, which will issue as U.S. Pat. No. 10,212,967 on Feb. 26, 2019, and which claims priority under 35 USC § 119 to U.S. Provisional Application No. 62/097,300, filed on Dec. 29, 2014, wherein the entire contents of each is hereby incorporated by reference.

BACKGROUND

There have been attempts to design smoking articles that extinguish when placed onto a substrate, and the tendency to do so is referenced herein as a smoking article having "low ignition propensity." Ideally, a low ignition propensity smoking article will continue to burn when freely suspended such as within the holder of an ashtray or when being held in the hand without puffing ("free burn"). However, many prior cigarette designs that achieve low ignition propensity characteristics exhibit high rates of self-extinguishment under free burn conditions.

SUMMARY

A wrapper of a smoking article, comprises: a base web; and at least one transverse banded region comprising a first zone of add-on material and a second zone of add-on material, the second zone having about 25% to about 75% less add-on material than the first zone, the second zone comprising a plurality of dots of add-on material spaced from adjacent dots in the second zone by a distance greater than a distance between adjacent dots in the first zone. The first zone can have a greater basis weight in grams per square meter than the second zone. The basis weight in grams per square meter of the first zone is at least twice the basis weight in grams per square meter of the second zone.

The banded region can further include a third zone of add-on material. The first zone and the third zone can have the same width. The second zone can be centrally located between the first zone and the second zone. The banded region is about 5 mm to about 9 mm wide. The first zone and the second zone comprise a single layer of add-on material. The second zone has a higher diffusivity as compared to the first zone. The second zone has a greater permeability compared to the first zone. The second zone can be about 0.5 mm to about 1.5 mm wide, preferably about 1.0 mm wide. The add-on material in the first zone and the second zone can have a same thickness.

A method of making a banded wrapper of a smoking article, comprises: supplying a base web; and forming at least one transverse banded region of add-on material, the banded region including a first zone, a second zone, and a third zone on the base web; wherein the second zone is centrally located between the first zone and third zone, wherein the second zone has a greater permeability compared to the first and third zones, wherein the second zone comprises a plurality of dots having smaller dimensions than dots in each of the first and third zones, and wherein the add-on material has a same thickness in the first, second, and third zones.

The method can further comprise forming the first, second, and third zones by printing a single printed layer of add-on material on the base web. The first and third zones can have a greater basis weight in grams per square meter than the second zone. The basis weight in grams per square meter of the first and third zones can be at least twice the basis weight in grams per square meter of the second zone.

The printing comprises printing with a gravure cylinder having a plurality of cells etched thereon. The cells in a central portion of the gravure cylinder can have smaller dimensions than cells on outer edges of the gravure cylinder. The method can further include: heating the add-on material; applying the heated add-on material to the gravure cylinder; and contacting the based web with the gravure cylinder. The heating step can comprise heating the add-on material to a temperature ranging from about 100° F. to about 140° F.

A wrapper of a smoking article, comprises: a base web; and at least one transverse banded region comprising a first zone of add-on material, a second zone of add-on material, and a third zone of add-on material, the second zone having about 25% to about 75% less add-on material than one of the first zone and the third zone, the banded region being about 5 mm to about 9 mm wide, the second zone being centrally located between the first zone and the third zone, the second zone comprising a plurality of dots of add-on material, wherein the first and third zones comprise add-on material which is uniform across each of the first and third zones.

A wrapper of a smoking article comprises: a base web; and a banded region comprising two substantially continuous bands of add-on material separated by a band of dots of add-on material.

A method of making a wrapper for a smoking article, the method comprises: supplying a base web; forming at least one transverse banded region of add-on material, the banded region including a first zone and a second zone, the second zone including a plurality of dots of the add-on material; and adjusting diffusivity of the wrapper by adjusting density of the dots in the second zone.

A wrapper of a smoking article comprises: a base web; a banded region at a location along the base web; the banded region comprising a first zone and a second zone, the second zone comprising a plurality of discrete dots of applied add-on material.

BRIEF DESCRIPTION OF THE DRAWINGS

FIG. 1 is a first embodiment of a smoking article having banded wrapper paper as described herein.

FIG. 2 is a schematic view of a wrapper as described herein.

FIG. 6 is an illustration of a gravure cylinder as described herein.

FIGS. 7A, 7B, and 7C are illustrations of a gravure cylinder etching process.

DETAILED DESCRIPTION

Figure 3:
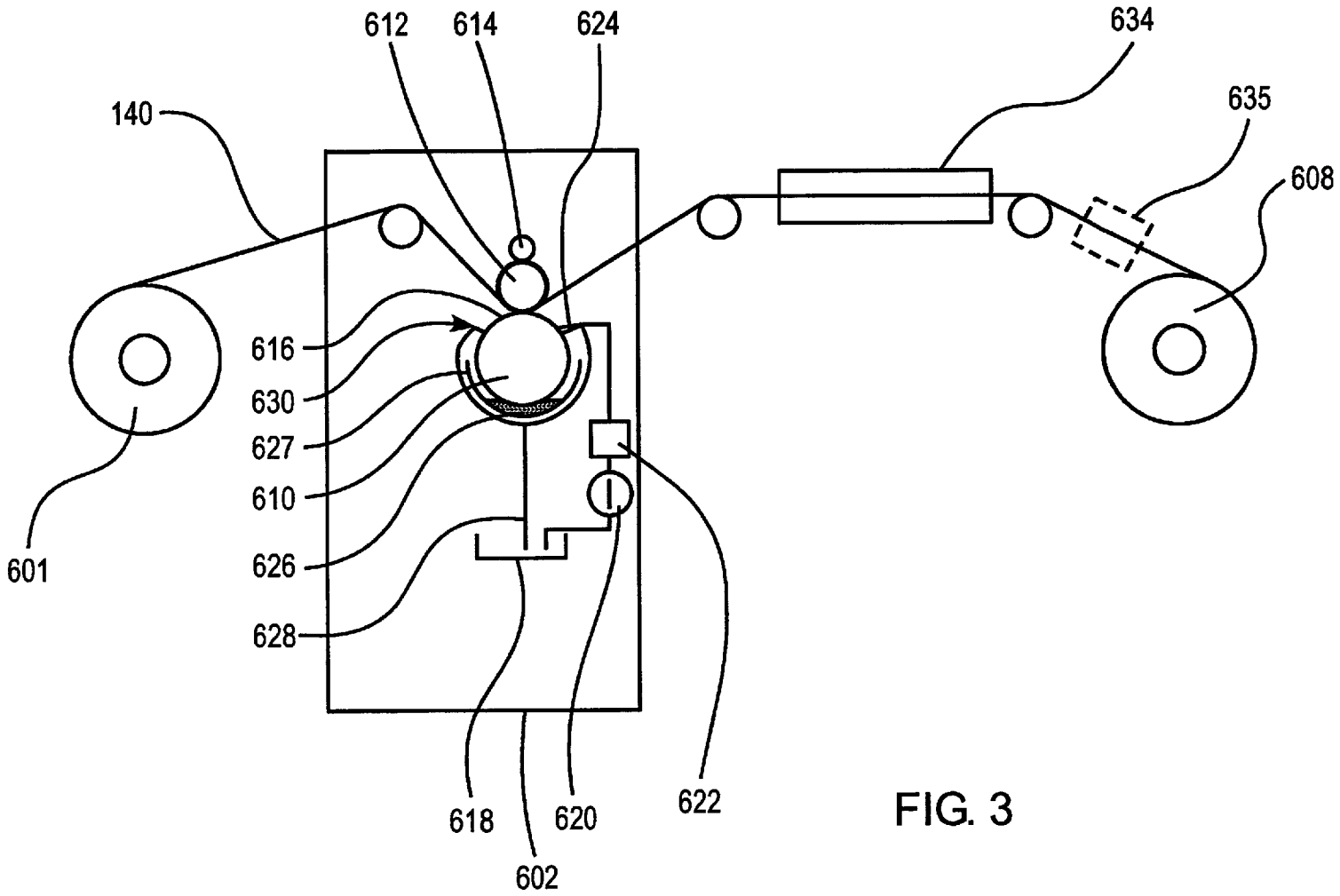
FIG. 3 is a schematic view of a gravure printing process suitable for producing embodiments of print banded wrapper.

Referring to FIG. 1, a smoking article 120, such as a cigarette, can comprise a tobacco rod 122 and a filter 132 attached to one end of the tobacco rod 122 with tipping paper 129. Preferably, the tobacco rod 122 comprises a column of shredded tobacco ("cut filler") and a wrapper 123 disposed about the column of tobacco, which wrapper 123 is constructed in accordance with teachings herein.

The tobacco rod 122 has a lightable or lit end 124 and a tipped end 130, which, in the case of non-filtered cigarettes, is referenced as the mouth end 130 of the cigarette 120. Cut filler tobacco is an industry-standard designation. Further, the tobacco rod 122 typically has a generally circular cross section, although an oval cross section and other non-circular shapes are within the scope of this disclosure. The wrapper is preferably sealed along a longitudinal seam to form the tobacco rod 122.

The tobacco rod has a nominal length measured from the edge 131 of the tipping paper to the free end of the tobacco rod along a longitudinal axis of smoking article. By way of example, that nominal length may lie in the range of about 60 to about 100 mm.

The "wrapper" paper 123 can include a "base web" 140 (shown in FIG. 3) that may be made from flax, wood pulp, cellulose fiber, or the like, and may have a plurality of banded regions 126 (shown in FIG. 2) applied to one or both sides. Preferably, the banded region 126 is applied to the inside of the wrapper 123 in the sense of how the wrapper 123 surrounds a column of tobacco in the tobacco rod 122.

In the manufacture of base web suited for the construction of the various embodiments of print banded paper disclosed herein, such manufacture usually will include the production of a roll of base web of several feet across (usually about 3 feet to about 5 feet across or in transverse dimension), which is then slit into ribbons that are wound on bobbins. Printing operations are preferably conducted on the rolls, but could be conducted after slitting. Preferably, the bobbins themselves will have a transverse dimension equivalent to the width needed to make tobacco rods 122 or an integral number of such widths (e.g., 1, 2, or 4 of such widths). The bobbins are adapted for use with typical cigarette making machines. The wrapper preferably has a dimension in cross-direction that takes into account the nominal circumference of the tobacco rod and an overlapping seam. As a result, when the wrapper is slit, the smoking article formed therefrom always has a longitudinal seam with an exact overlap.

For purposes of this disclosure, "longitudinal" refers to the direction along the length of a tobacco rod (e.g., along the axis 134 in FIG. 1), or along the length of a base web 140 (e.g., arrow 142 in FIG. 2) used in the preparation of wrapper that, in turn, may be used to fabricate a tobacco rod.

For purposes of this disclosure, "transverse" refers to the direction circumferentially around a tobacco rod 122 (see FIG. 1), or transversely of a base web 140 (e.g., arrow 144 in FIG. 2) used in the preparation of wrapper that, in turn, may be used to fabricate a tobacco rod.

For purposes of this disclosure, a "banded region" or "zone" is an area 126 (see FIG. 2) on an underlying base web 140 to which an add-on material has been applied. The banded region typically exhibits a two-dimensional pattern or array on the base web 140. More specifically, the pattern or array may comprise repeating units in the longitudinal direction 142 of the base web 140. The regions 126 of add-on material are applied to the wrapper 123 to obtain satisfactory or improved Ignition Propensity ("IP") characteristics and may also obtain improved Self-Extinguishment ("SE") characteristics.

The regions 126 of add-on material are spaced along the base web 140 such that at least one region 126 of add-on material is positioned between the first and second ends 128, 130 of the tobacco rod 122 in each finished smoking article, but more preferably at least two regions 126 of add-on material may appear on the tobacco rod 122. The region 126 of add-on material preferably extends in the circumferential direction at one or more spaced locations along the axis 134, extending around the tobacco rod 122 of the smoking article 120. While the region 126 of add-on material is depicted in this disclosure as containing discontinuities in its circumferential direction, other configurations for the add-on material are within the spirit and scope of this disclosure, including, but not limited to, configurations where the add-on material is substantially continuous.

It is noted for sake of convention that, in describing dimensions of various embodiments herein, that band or zone "width" extends in a longitudinal direction 134 (see FIG. 1) of the tobacco rod 122, whereas a dimension in the circumferential direction will be expressed as "circumferential" or "transverse" or "in cross-direction."

Where the banded region 126 extends transversely of the base web 140 (or circumferentially around a tobacco rod), the "width" of the banded region 126 is measured in the longitudinal direction 142 from the leading edge 146 to the trailing edge 148 and is preferably lies in the range of from about 5 to about 9 mm (from the leading edge 146 to the trailing edge 148), more preferably from about 5.5 to about 7.5 mm, and even more preferably from about 6 to about 7 mm. Further, banded regions may have a "phase" in the range of 20 mm to 30 mm, preferably a 25 mm "phase" or a 27 mm "phase" (i.e., the spacing from the leading edge 146 of one banded region 126 to the leading edge 146 of the next adjacent banded region). Preferably, the banded regions of add-on material reduce permeability of the wrapper to the range of from about 0 to about 12 CORESTA, and the banded regions have a diffusivity ranging from about 0 to about 400 cm/sec.

For purposes of this disclosure, "band spacing" refers to the distance between the trailing edge 148 of one banded region 126 and the leading edge 146 of an adjacent banded region 126 on the base web 140 from which a wrapper is fashioned.

As used herein, the phrase "leading edge" refers to the edge 146 (see FIG. 1) of a banded region 126 that is closest to an approaching coal during smoldering of a smoking article 120 whose wrapper 123 contains the banded region 126, while the phrase "trailing edge" refers to the edge 148 of a banded region 126 that is farthest from an approaching coal during smoldering of a smoking article 120 whose wrapper 123 contains the banded region 126.

For purposes of this disclosure, "layer" refers to a quantity of add-on material applied to a base web from which a wrapper is fabricated. Each banded region 126 may be formed by applying a "layer" of a film-forming composition to the base web 140 of the wrapper to reduce the permeability of the paper in the corresponding banded region. Preferably, the film forming composition is aqueous, but may instead or in addition be non-aqueous.

Where a film-forming composition is used, that "film-forming composition" preferably may include water and a high concentration of an occluding agent, e.g., about 14% to about 50% by weight of the composition. The film-forming compound can include one or more occluding agents such as starch, alginate, cellulose or gum and may also include calcium carbonate as a filler. Further, the film-forming composition preferably includes an anti-wrinkling agent. Where starch is the film-forming compound, a concentration of at least about 25% may be particularly advantageous, and a concentration of about 30% may be used. The printing solution can be manufactured as described in U.S. Patent Application Publication No. 2012/0285477 published Nov. 15, 2012, the entire content of which is incorporated herein by reference thereto.

An "anti-wrinkling agent" is a material which inhibits transverse shrinkage of the base web 140 (see FIG. 2) during printing or other conversion operations. A suitable anti-wrinkling agent may be selected from the group consisting of 1,2 propylene glycol, propylene glycol, glycerin, and starch plasticizing agents.

The film-forming composition may be applied to the base web of the wrapper 140 using gravure printing as described herein.

When discussing application rates for add-on material applied using gravure printing techniques, those skilled in the art often use values with "X" as a suffix to refer to a volumetric application rate. The table below sets out the volumetric equivalents for "X" in terms of billion cubic microns per square inch, or "BCM":

TABLE 1

| Volume | BCM |
|---|---|
| 0.5X | 3.4 |
| 1.0X | 4.6 |
| 1.5X | 6.8 |
| 2.0X | 10 |
| 2.5X | 10.7 |
| 3.0X | 11.2 |
| 3.5X | 13.6 |
| 4.0X | 17.8 |
| 4.5X | 19.9 |
| 5.0X | 22.4 |
| 5.5X | 24.7 |
| 6.0X | 27.8 |

In this specification, the unit of measurement for basis weight, gram(s) per square meter, is abbreviated as "gsm".

For purposes of this disclosure, references to an "X % starch solution" refer to an aqueous starch solution in which the starch weight is X % of the solution weight (e.g., weight of starch divided by the sum of starch weight and aqueous component weight) unless otherwise noted.

The wrapper includes a base web which typically is permeable to air. Permeability of wrapper is typically identified in CORESTA units. A CORESTA unit measures paper permeability in terms of volumetric flow rate (i.e., $cm^3$/sec) per unit area (i.e., $cm^2$) per unit pressure drop (i.e., cm of water). The base web of conventional wrapper also has well-known basis weights, measured in grams per square meter, abbreviated as "gsm".

For purposes of this description, the base web of a preferred wrapper has a permeability of at least about 20 CORESTA units. Most preferably, the wrapper has a permeability greater than about 30 CORESTA, such as common base webs having nominal permeabilities of about 33 and about 46 CORESTA with a basis weight of about 25 gsm. For some applications, the base web may have a permeability of greater than about 60 CORESTA, or greater than about 80 CORESTA, or even higher permeability values.

When using the preferred add-on solutions, base webs and application techniques of the teachings which follow, a printing solution, upon its application to a base web and drying, forms an air-occlusive film on the base web that is effective to locally reduce diffusivity values from a diffusivity level of about 2 cm/sec or greater (for the base web in its original condition) to a value in the range of 0.0 to about 0.25 cm/sec, more preferably less than about 0.15 to about 0.20 cm/sec, as measured by a Sodim $CO_2$ Diffusivity Tester (purchased from Sodim SAS of France).

To measure the diffusivity of a piece of paper using a Diffusivity Tester, the paper is positioned within a clamping head so that the paper separates two vertically arranged chambers. The upper chamber contains a carrier gas, such as nitrogen, while the lower chamber contains a marker gas, such as carbon dioxide. As there is no pressure difference between the two chambers, any migration of gases is due to differences in concentrations of the gases, and there is no permeability effect, which occurs when a pressure difference is maintained between two surfaces of the paper. After a predetermined period of time (e.g., for about 25 seconds or less), the concentration of carbon dioxide within the nitrogen stream of the upper chamber is measured in an analyzer. A computer then converts the detected level of concentration into a measure of diffusivity.

Ignition Propensity or IP is a standard test conducted as set forth in ASTM E 2187-04, "Standard Test Method for Measuring the Ignition Strength of Smoking Articles", which is incorporated herein in its entirety by this reference thereto. Ignition propensity measures the probability that a smoking article, when smoldering and placed on a substrate, will generate sufficient heat to maintain smoldering of the tobacco rod. Low values for IP are desirable as such values correlate with a reduced likelihood that a smoldering smoking article, when inadvertently left unattended upon a substrate, will cause combustion in the substrate. An IP value of a smoking article should be no greater than about 25%, and preferably no greater than about 20%, and even more preferably no greater than about 10% as described in US Patent Application Publication No. 2013/0306082 published Nov. 21, 2013, the entire content of which is incorporated herein by reference thereto.

Self-Extinguishment or SE herein is a reference to smoldering characteristics of a smoking article under free burn conditions. To evaluate SE, a laboratory test is conducted at a temperature of 23° C.±3° C. and relative humidity of 55%±5%, both of which should be monitored by a recording hygrothermograph. Exhaust hood(s) remove combustion products formed during testing. Prior to testing, smoking articles to be tested are conditioned at 55%±5% relative humidity and 23° C.±3° C. for 24 hours. Just prior to testing, the smoking articles are placed in glass beakers to assure free air access.

SE testing takes place within an enclosure or test box. A single port smoking machine or an electric lighter is used to ignite the smoking articles for the test. During testing, an apparatus or "angle holder" holds the smoking articles to be tested by holding an end at angles of 0° (horizontal), 45°, and/or 90° (vertical). Preferably, twenty (20) smoking articles are tested at each of the 0°, 45°, and 90° positions. If more than one apparatus is used, the apparatuses are preferably positioned such that the smoking articles face away from each other to avoid cross interference. If a smoking article goes out before the front line of the smoldering coal reaches the tipping paper, the outcome is scored as "self-extinguishment"; on the other hand, if the smoking article continues smoldering until the front line of the smoldering coal reaches the tipping paper, then the outcome is scored as "non-extinguishment". Thus, for example, an SE value of 95% indicates that 95% of the smoking articles tested exhibited self-extinguishment under free burn conditions; while an SE value of 20% indicates that only 20% of the smoking articles tested exhibited self-extinguishment under such free burn conditions.

The SE value for a smoking article should be no greater than about 80% (at horizontal orientation) and preferably no greater than about 50% and even more preferably no greater than about 25% as described in US Patent Application Publication No. 2013/0306082 published Nov. 21, 2013, the entire content of which is incorporated herein by reference thereto.

It is desirable to achieve IP performance that meets and exceeds governmental requirements. Moreover, as also previously noted, that desired IP performance often adversely impacts the SE performance of the smoking article. Stated differently, while the IP performance may meet or exceed the governmental requirements, that IP performance is typically associated with a smoking article that will self-extinguish when hand held by a smoker—an SE of 100%. Since smokers ordinarily prefer not to need to relight a smoking article, improvement of SE performance while maintaining IP performance constitutes a highly desirable feature for improved wrappers. Applicant has discovered banded regions on wrapper that provide improved SE performance while maintaining a desired level IP performance.

To improve SE performance, certain band configurations disclosed herein are useful in constructing smoking articles having both improved SE performance and desired IP performance. For example, a band configuration such as shown in FIG. 2 is capable of better sustaining smoldering during free burns, yet when placed adjacent a substrate, does not sustain smoldering.

Preferably, the band configuration shown in FIG. 2 includes at least two regions 126 of add-on material, wherein each region 126 comprises a first zone 202, a second zone 203, and optionally a third zone 204. The first zone 202 and the third zone 204 have about the same amount of add-on material printed on the base web, while the second zone 203 has about 20% to about 80% (e.g., about 25% to about 75%, about 30% to about 70%, about 35% to about 65%, about 40% to about 60%, or about 45% to about 55%) less add-on material printed on (applied to) the base web. Preferably, the add-on material of each zone is applied as a plurality of dots arranged in a pattern generally within the zone to produce a banded region on the base web. Moreover, each dot of add-on material in the second zone 203 has smaller dimensions than each dot in the first zone 202 and the third zone 204. Where the dots are applied in a gravure process, each dot may be applied from a generally hexagonal cell formed (engraved or etched) in the gravure cylinder. Because the walls between adjacent cells of the gravure cylinder used to form the dots in the second zone 203 are thicker, less material is applied and the dots tend to stay separated once printed on the base web. In contrast, dots in the first zone 202 and third zone 204 are formed by a gravure cylinder including cells having thinner walls between adjacent cells, such that more material is applied and the dots may run together when printed on the base web.

In embodiments, the first zone 202 and the third zone 204 can have a diffusivity ranging from about 0 to about 0.1 cm/sec (e.g. about 0.01 to about 0.09 cm/sec, about 0.02 to about 0.08 cm/sec, about 0.03 to about 0.07 cm/sec or about 0.04 to about 0.06 cm/sec), and the second zone 203 can have a diffusivity ranging from about 0.1 to about 0.4 cm/sec (e.g. about 0.15 to about 0.35 cm/sec or about 0.2 to about 0.3 cm/sec).

As shown in FIG. 6, the gravure cylinder (roller) 610 includes a plurality of cells etched thereon in a pattern corresponding to the aforementioned zones 202, 203, 204. Preferably, the gravure cylinder 610 includes a first and a third zones 712 and a second zone 710 there between. As shown, walls 720 between adjacent cells 722 in the first and third zones 712 can have a narrower width than walls 724 between adjacent cells 726 of the second zone 710.

As shown in FIGS. 7A, 7B, and 7C, the cells of the gravure cylinder can be applied using a gravure cylinder that has been etched. Suitable etching processes and gravure cylinders can be obtained from Heliograph Holding GmbH. As shown, photoresist 801 is applied to a metallic surface 800, and lasers 802 are used to activate the photoresist, which serves to mask areas where walls are desired. Thus, the cylinder 610 can be formed having thinner walls 720 in some regions and thicker walls 724 in other regions.

Preferably, region 126 (see FIG. 1) is about 5 mm to about 9 mm wide, more preferably about 5.5 mm to about 7.5 mm. Preferably, the second zone 203 is located in a central (or intermediate) portion 207 of the region 126 so as to lie between the first zone 202 and the third zone 204. Preferably, the first zone 202 and the third zone 204 have the same width such that the add-on region 126 is symmetrical about the second zone 203. In addition, the second zone 203 is about 0.5 mm to about 1.5 mm wide or about 5% to about 20% of the width of the region 126. In addition, the second zone 203 has about 25% to about 75% less add-on material applied thereto as compared to the first zone 202 (or the third zone 204).

To form the region 126, a single pass gravure printing process can be utilized. Alternatively, multiple pass gravure printing can be utilized. FIG. 3 is a schematic view of a single stage printing apparatus. With reference to the above-description for printing, a supply reel 601 supplies a blank web 140 of paper to a gravure printing station 602 where a pattern is printed on the blank web 140 and dried in a drier 634. The dried, patterned base web then advances to a collection reel 608. If desired, a wide base web may be slit or divided by a slitter 635 into a plurality of narrower bobbins after the printing operation, where the bobbins have a width corresponding to that required for a smoking article. The optional slitter 635 may be used on the base web as that base web leaves the printing station, or the slitter and slitting operation may be conducted at a different location. In the printing station 602, a gravure roller 610 contacts a reservoir 626 of add-on material, moves through a doctor blade 630 and contacts one side of the base web 140 in the nip 616 between the gravure roller 610 and an impression cylinder 612.

The add-on material is delivered from a reservoir 618 to the applicator 624 by a suitable pump 620. Add-on material discharged from the pump 620 preferably passes through a heat exchanger 622 where the temperature of the add-on material is elevated to the range of about 100° F. to about 140° F. The heated add-on material then flows to the applicator 624 where it is spread on the gravure roller 610. Excess add-on material accumulates in the bath 626 from which excess add-on material returns to the reservoir 618. The add-on material preferably has the characteristics described more fully above so that the appropriate amount of add-on material can be applied to the base web 140 during a single printing application as described in U.S. Patent Application Publication No. 2012/0285477 published Nov.

15, 2012 and U.S. Patent Application Publication No. 2008/0295854 published Dec. 4, 2008, the entire content of each of which is incorporated herein by reference thereto.

The following example of a solution used for single-pass printing of a patterned region on cigarette wrapper provides further foundation and background to explain the significance of the results now obtainable.

An aqueous starch solution can be prepared by mixing oxidized starch, such as Flow-Max 8, a tapioca-based oxidized starch available from Ingredion Incorporated, with sufficient water to make an aqueous solution having an initial composition of 30% starch, by weight of solution. Then 1,2 propylene glycol and calcium carbonate can be mixed or incorporated into the starch solution as additives. The weight of propylene glycol introduced can be about 25.7% of the weight of the starch used for the solution. The weight of the calcium carbonate introduced can be about 68.6% of the weight of the starch used for the solution.

For example, an aqueous starch solution can include water in an amount ranging from about 50% to about 65% by weight based on the weight of the solution, starch in an amount ranging from about 20% to about 30% by weight based on the weight of the solution, propylene glycol in an amount ranging from about 5% to about 12% by weight based on the weight of the solution, and chalk in an amount ranging from about 5% to about 15% by weight based on the weight of the solution.

The resulting printing solution can be heated to a temperature in the range of about 100° F. to about 140° F. The final printing solution can be applied as a banded pattern, as described with respect to FIG. 2, to a base web of cigarette wrapper having a nominal width ranging from about 36 inches (i.e., about 920 mm) to about 60 inches in a gravure printing press. The base web can have a permeability ranging from about 24 to about 80 CORESTA.

The final printing solution can be applied to the base web at a target rate of about 20 to 50 BCM (billion cubic microns per square inch) in the first zone 202 and the third zone 204. The final printing solution can be applied to the base web at a target rate of about 5 BCM to about 38 BCM in the second zone 203, such that the second zone 203 has about 25% to about 75% less add-on material as compared to the first zone 202 and the third zone 204. Thereafter the base web can be dried so that the printing solution dries.

Once printed, the base web can be advanced under tension to a slitter where the nominal width of the base web can be longitudinally cut into a plurality of strips or ribbons, each strip having a width of about 27 mm—the width required to surround a conventional tobacco rod and have a longitudinal glue seam. While the base web is still under tension, the plurality of strips can be simultaneously wound onto individual bobbins.

Figure 4:
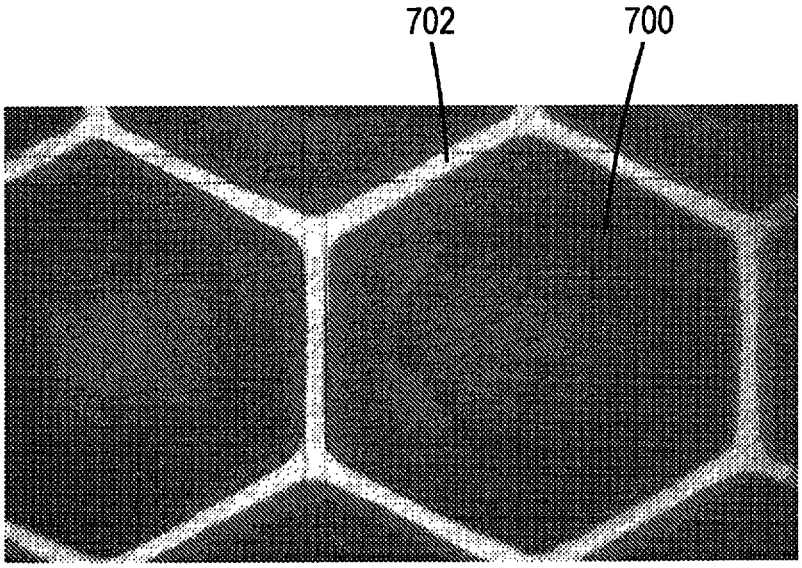
FIG. 4 is an image of engraved cells of a gravure cylinder at full tone.

As shown in FIG. 4, the gravure roller 610 (shown in FIG. 3) has a plurality of cells 700, such as hex (hexagonal) cells. The cells 700 on the outer portions of the roller 610 can have walls 702 ranging from about 12 to about 20 microns in width between adjacent cells 700. These cells 700 contain the add-on material to be deposited in the first zone 202 and the third zone 204 of the add-on region 126.

Figure 5:
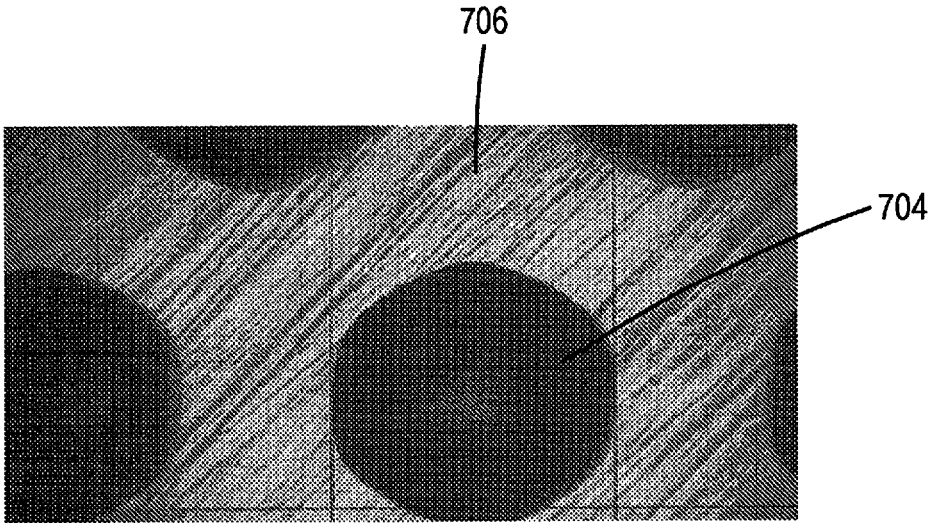
FIG. 5 is an image of engraved cells of a gravure cylinder having smaller volumes as compared to the cells of FIG. 4.

As shown in FIG. 5, the gravure roller 610 has a plurality of cells 704 in a central etched (engraved) portion of the gravure roller 610. The cells can be generally hexagonal or generally circular. The cells 704 have a smaller volume due to the increase in width of the cell walls 706. Preferably, a depth of the cells 700, 704 is the same. However, in other embodiments, the depth of the cells 700, 704 can be different. The walls 706 can have a width that causes the volume of each cell 704 to be about 20% to about 80%, more preferably about 25% to about 75% less than the cells 700. Moreover, the width of the walls 706 between adjacent cells 704 can range from about 20 microns to about 80 microns depending on the desired final volume of each cell 704. In use, the cells 704 contain the add-on material to be deposited in the second zone 203 of the add-on region 126.

While not wishing to be bound by theory, it is believed that because the cells have a narrower width, shown in FIG. 5, as compared to cells having a full volume as shown in FIG. 4, the dots printed by the cells of the gravure roller are small enough and deposit a small enough volume of add-on material to substantially prevent the add-on material from flowing together between adjacent dots. Thus, the second zone 203 provides greater airflow and higher diffusion as compared to the first zone 202 and the third zone 204. The discrete dots formed in the second zone 203 establish an unoccluded portion of the zone 203 (where the dots are absent) and an occluded portion of the zone 203 (comprising the sum of the discrete dots). Adjustment of diffusivity in the zone 203 can be facilitated by changing the size and/or number of the dots in the zone 203. Diffusivity of the paper can be adjusted by adjusting the wall thickness between cells, and thus the density of the cells within the second zone 203 of the band.

Figure 8:
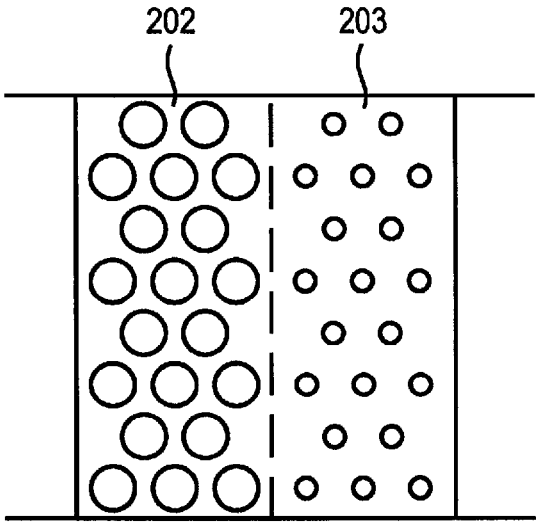
FIG. 8 is an illustration of a banded region as described herein.
Figure 9:
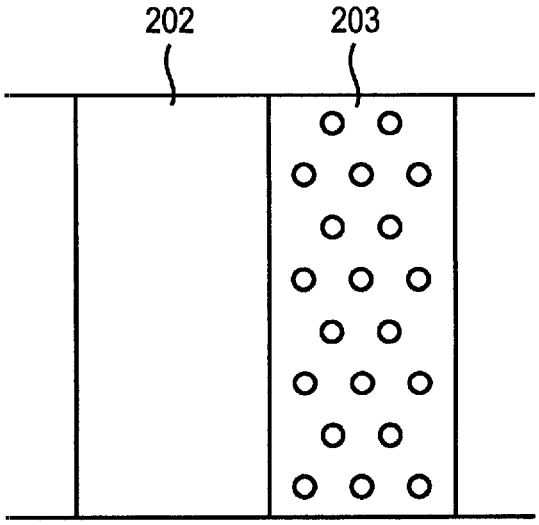
FIG. 9 is an illustration of a banded region as described herein.

As shown in FIG. 8, the first zone 202 can include discrete dots that are positioned closer together than and/or are larger than dots in the second zone 203. As shown in FIG. 9, in other embodiments, the dots in the first zone 202 may run together and form a substantially uniform layer of add-on material on the wrapper, while the dots in the second zone 203 are maintained as discrete dots. It is contemplated that under certain conditions, the second zone 203 may include dots that run together and form a substantially uniform layer of add-on material on the wrapper.

In addition, about 10% IP can be obtained for paper having diffusion ranging from about 0 to about 0.240 cm/sec, while maintaining about 18% SE, by changing the print area in the center of the band and the amount of material printed thereon.

Figure 10:
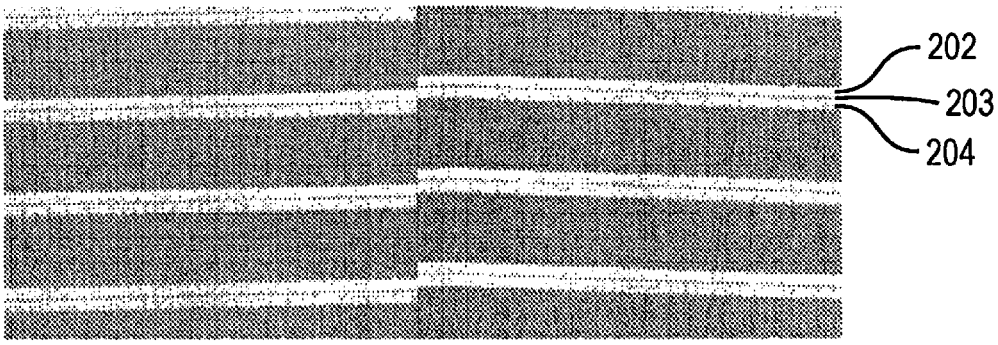
FIG. 10 is a photograph of an exemplary banded region as described herein.

For example, as shown in FIG. 10, the banded region can include the first zone 202 and the third zone 204, with each of the first and third zones 202, 204 having a width of about 2.5 mm wide. The banded region can also include a second zone 203 having a width of about 0.4 mm and including about 50% less add-on material.

Figure 11:
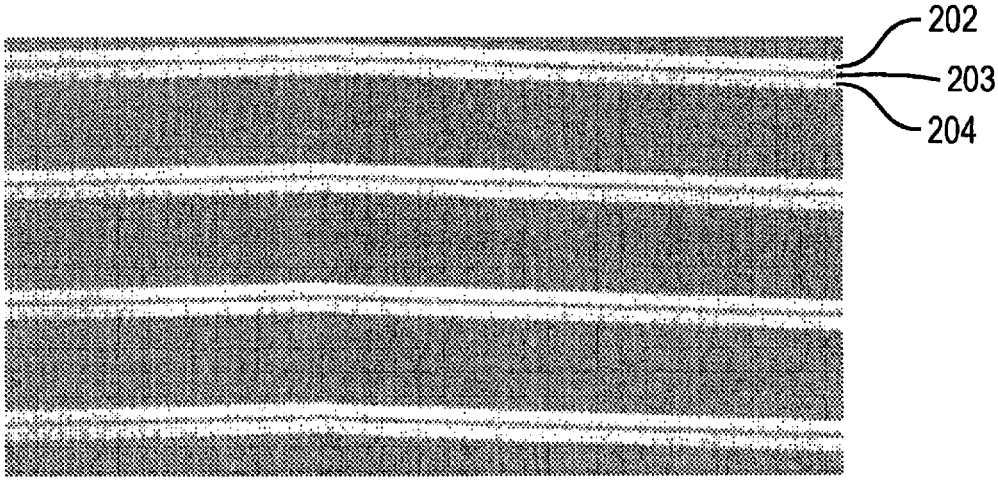
FIG. 11 is a photograph of an exemplary banded region as described herein.

For example, as shown in FIG. 11, the banded region can include the first zone 202 and the third zone 204, with each of the first and third zones 202, 204 having a width of about 2.5 mm wide. The banded region can also include a second zone 203 having a width of about 1.0 mm and including about 50% less add-on material.

Figure 12:
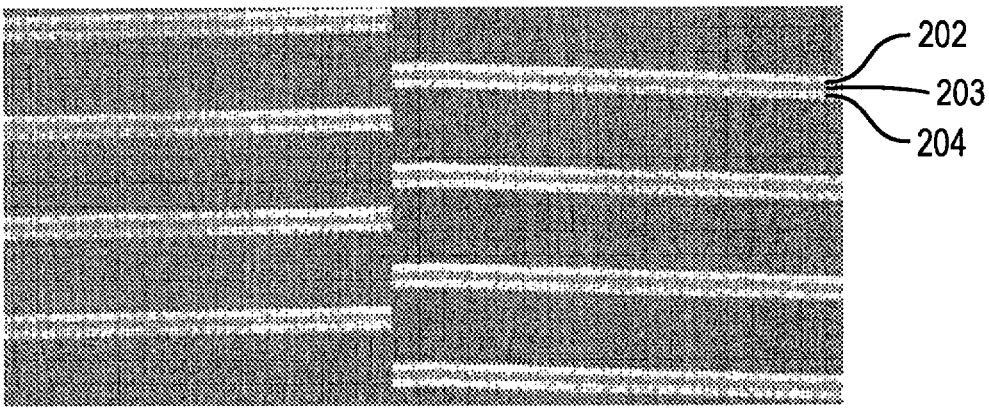
FIG. 12 is a photograph of an exemplary banded region as described herein.

For example, as shown in FIG. 12, the banded region can include the first zone 202 and the third zone 204, with each of the first and third zones 202, 204 having a width of about 2.0 mm wide. The banded region can also include a second zone 203 having a width of about 2.0 mm and including about 75% less add-on material.

When the word "about" is used in this specification in connection with a numerical value, it is intended that the associated numerical value include a tolerance of +/−10% around the stated numerical value. Moreover, when reference is made to percentages in this specification, it is intended that those percentages are based on weight, i.e., weight percentages.

The terms and phrases used herein are not to be interpreted with mathematical or geometric precision, rather geometric terminology is to be interpreted as meaning approximating or similar to the geometric terms and concepts. For example, rounded or filleted corners are intended to be included in geometric shapes such as a rectangular, hexagonal, and the like. Terms such as "generally" and "substantially" are intended to encompass both precise meanings of the associated terms and concepts as well as to provide reasonable latitude which is consistent with form, function, and/or meaning.

It will now be apparent to those skilled in the art that this specification describes a new, useful, and nonobvious smoking article, wrapper therefor, and process for making the wrapper and smoking article. Although preferably, about a 0.4 mm to about a 1.5 mm wide zone 203 of high diffusivity is located in a central region of a band 126, it could be located closer to either edge 146, 148 of a band 126 or oriented differently, such as longitudinally or obliquely. It will also be apparent to those skilled in the art that numerous modifications, variations, substitutes, and equivalents exist for various aspects of the smoking article, wrapper and process that have been described in the detailed description above. Accordingly, it is expressly intended that all such modifications, variations, substitutions, and equivalents that fall within the spirit and scope of the invention, as defined by the appended claims, be embraced thereby.

I claim:

1. A method of making a wrapper for a smoking article, the method comprising:

supplying a base web;

forming at least one transverse banded region of add-on material on the base web, the add-on material including starch, the transverse banded region including a first zone and a second zone, the second zone including a plurality of dots of the add-on material; and forming a density of the dots in the second zone so that diffusivity of the second zone is greater than the diffusivity of the first zone wherein the forming at least one transverse banded region comprises forming the first zone, the second zone, and a third zone by printing a single printed layer of add-on material on the base web, the first, second and third zones including dots of the add-on material formed by a gravure cylinder having hexagonal cells with cell walls 12 to 20 microns thick in the first and third zones and 20 to 80 microns thick in the second zone, the hexagonal cells in the second zone having a volume about 25% to about 75% less than the volume of the hexagonal cells in the first and third zones.

2. The method of claim 1, wherein the first and third zones have a greater basis weight in grams per square meter than the second zone.

3. The method of claim 2, wherein the basis weight in grams per square meter of the first and third zones is at least twice the basis weight in grams per square meter of the second zone.

4. The method of claim 1, wherein the add-on material has a same thickness in the first, second, and third zones.

5. A wrapper of a smoking article comprising:

a base web;

a banded region at a location along the base web;

the banded region comprising a first zone and a second zone, the second zone comprising a plurality of dots of applied add-on material that includes starch, wherein diffusivity in the second zone is a function of a size of the dots in the second zone, number of the dots in the second zone, or a combination thereof, wherein the banded region includes a third zone of the add-on material, the first and third zones including dots of the add-on material, the second zone having about 25% to about 75% less add-on material than the first zone, the dots in the second zone spaced from adjacent dots in the second zone by a distance greater than a distance between adjacent dots in the first zone, wherein the second zone is located between the first zone and the third zone.

6. A wrapper of a smoking article comprising:

a base web;

a banded region at a location along the base web;

the banded region comprising a first zone and a second zone, the second zone comprising a plurality of dots of applied add-on material that includes starch, wherein diffusivity in the second zone is a function of a size of the dots in the second zone, number of the dots in the second zone, or a combination thereof, wherein the banded region includes a third zone of the add-on material, the first and third zones including dots of the add-on material, the add-on material is uniform across each of the first and third zones, the dots in the first and second zones formed by a gravure cylinder having hexagonal cells with cell walls 12 to 20 microns thick in the first zone and 20 to 80 microns thick in the second zone, the hexagonal cells in the second zone having a volume about 25% to about 75% less than the volume of the hexagonal cells in the first zone.

7. A wrapper of a smoking article comprising:

a base web;

a banded region at a location along the base web;

the banded region comprising a first zone and a second zone, the second zone comprising a plurality of dots of applied add-on material that includes starch, wherein diffusivity in the second zone is greater than diffusivity in the first zone, wherein the banded region includes a third zone of the add-on material, the first and third zones including dots of the add-on material, the second zone having about 25% to about 75% less add-on material than the first zone, the dots in the second zone spaced from adjacent dots in the second zone by a distance greater than a distance between adjacent dots in the first zone, wherein the second zone is located between the first zone and the third zone.

8. A wrapper of a smoking article comprising:

a base web;

a banded region at a location along the base web;

the banded region comprising a first zone and a second zone, the second zone comprising a plurality of dots of applied add-on material that includes starch, wherein diffusivity in the second zone is greater than diffusivity in the first zone, wherein the banded region includes a third zone of the add-on material, the first and third zones including dots of the add-on material, the add-on material is uniform across each of the first and third zones, the dots in the first and second zones formed by a gravure cylinder having hexagonal cells with cell walls 12 to 20 microns thick in the first zone and 20 to 80 microns thick in the second zone, the hexagonal cells in the second zone having a volume about 25% to about 75% less than the volume of the hexagonal cells in the first zone.

* * * * *